United States Patent [19]

Bosyj et al.

[11] Patent Number: 4,720,887

[45] Date of Patent: Jan. 26, 1988

[54] UPPER FILL TUBE CONFIGURATION

[75] Inventors: Nick M. Bosyj, North Canton; Donald B. Tschudy, Canton, both of Ohio

[73] Assignee: The Hoover Company, North Canton, Ohio

[21] Appl. No.: 900,003

[22] Filed: Aug. 25, 1986

Related U.S. Application Data

[63] Continuation-in-part of Ser. No. 820,963, Jan. 22, 1986, abandoned.

[51] Int. Cl.[4] ..... A47L 9/14

[52] U.S. Cl. ..... 15/351; 15/347; 285/7

[58] Field of Search ..... 15/351, 347; 285/7

[56] References Cited

U.S. PATENT DOCUMENTS 2,260,236 10/1941 Smellie ..... 15/351

2,730,750 1/1956 La Briere ..... 15/351 X 2,738,538 3/1956 Vance ..... 15/351

4,621,390 11/1986 Hampton et al. ..... 15/351

FOREIGN PATENT DOCUMENTS 287538 4/1953 Switzerland ..... 15/351

*Primary Examiner*—Chris K. Moore

*Attorney, Agent, or Firm*—Gerald H. Kreske; Richardson B. Farley

[57] ABSTRACT

The invention provides an upper fill tube configuration for a vacuum cleaner that includes: a rigid upper fill tube that communicates, adjacent its upper end, with a dirt collecting receptacle; a flexible tube extending from the cleaner foot; communicating with the rigid upper fill tube and removably secured to it and a latch arrangement carried, in part, by the flexible tube and, in part, by the upper fill tube to releasably retain the two together.

4 Claims, 5 Drawing Figures

UPPER FILL TUBE CONFIGURATION

This patent Application is a continuation-in-part of patent application Ser. No. 820,963, filed Jan. 22, 1986, now abandoned, and owned by a common assignee.

BACKGROUND OF THE INVENTION

1. Field of the Invention

This invention relates to floor care appliances and, more particularly, relates to an upper fill tube configuration for a vacuum cleaner.

2. Summary of the Prior Art

Vacuum cleaners are known which have an upper fill tube arrangement for feeding dirty air to a receptacle, this fill tube, in some manner, being confluently connected to a tube, generally flexible, extending upwardly from the cleaner foot. These two members necessarily must be attached together and a variety of clamps and latches have been utilized but heretofore it has now been known to latchably connect a rigid upper fill tube with a flexible tube of the cleaner inserted within it.

Accordingly, it is an object of the invention to attach, in a vacuum cleaner, an outer rigid upper fill tube with an inner flexible tube in a releasable manner and to utilize a latching arrangement, partly carried by the flexible tube and partly carried by the rigid upper fill tube to accomplish this.

It is a further object of the invention to include a flexible tube adapter that captivates the flexible tube and directly carries a part of the latch for engagement with the latch part of the rigid upper fill tube.

It is a still further object of the invention to make the adapter from resilient plastic so it may be partially deformed for release of the flexible tube from the rigid upper fill tube.

It is an even further object of the invention to provide a tapered adapter tube that extends above the bellows and bellows adapter to serve as a lead in for cleaner air to the rigid upper fill tube.

It is an even further object of the invention to provide a new and improved upper fill tube configuration.

It is a still further object of the invention to provide an upper fill tube configuration that is easy to assemble and disassemble.

SUMMARY OF THE INVENTION

The invention is disposed in a vacuum cleaner. It includes a rigid upper fill tube that extends upwardly from adjacent a hood or foot of the cleaner and, specifically, in the instant structure, is formed from the hollow handle of the cleaner. This handle is pivoted to the cleaner foot by downwardly extending lug portions integral with it, with the lug portions spaced apart to receive a flexible bellows-like tube element. This is attached, at its lower end, to the motor fan system. The handle has a sidewardly extending tubular portion, towards it upper end, that communicates with a dirt receiving bag to provide a top fill function.

The bellows tube element includes a bellows section having an accordian-like extent between upper and lower connecting sections. The lower connecting section includes an abutment flange and a short outwardly extending tubular section extending beyond it that is sealingly received over a discharge tube extending from adjacent fan discharge. The bellows tube extends upwardly from there into the lower duct of the handle-upper fill tube. The upper end connecting section of the bellows tube element includes an abutment flange, an annular groove above it and a tubular section above that.

The bellows tube adapter comprises a hollow housing having a series of three downwardly extending fingers which lie resiliently along lower reaches of the upper fill tube. A middle finger of the three fingers includes a radially outwardly directed button that resiliently engages in a through bore in a side wall of the lower handle duct upper fill tube. This button finger and the other two fingers of the bellows tube adapter fix its location within the upper fill tube. Extending integrally and generally perpendicularly to the three fingers, the bellows tube adapter includes a planer surface within the hollow housing and a skirt formed by vertical side walls opening upwardly above the planer surface. These side walls tend to rigidify the bellows tube adapter. Offset to one side of the bellows tube adapter, is an oval-like upstanding wall the same height as the skirt walls but within them. Disposed below this oval wall is an oval bore through the planer surface, this bore being slightly smaller than the bore afforded by the upstanding oval wall to provide an oval lip within the oval upstanding wall.

The method of connection of the bellows tube to the bellows tube adapter should now be apparent. The annular groove of the upper connecting section of the bellows tube is received over the dual lip of the bellows tube adapter with the abutment flange of the bellows tube engaging the underside of the planer surface of the bellows tube adapter. The tubular section of the bellows tube nests in the bore formed by the oval wall of the bellows tube adapter.

The structure is generally completed by the use of an adapter tube mounted above the bellows tube adapter. This tube includes upper and lower lead in sections, slightly tapered; which sealingly fit in the bellows tube adapter and upper reaches of the upper fill tube by being glued into the lower handle duct. Between these two points the tube adapter is configured to provide for a smooth transition flow of dirt laden air.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
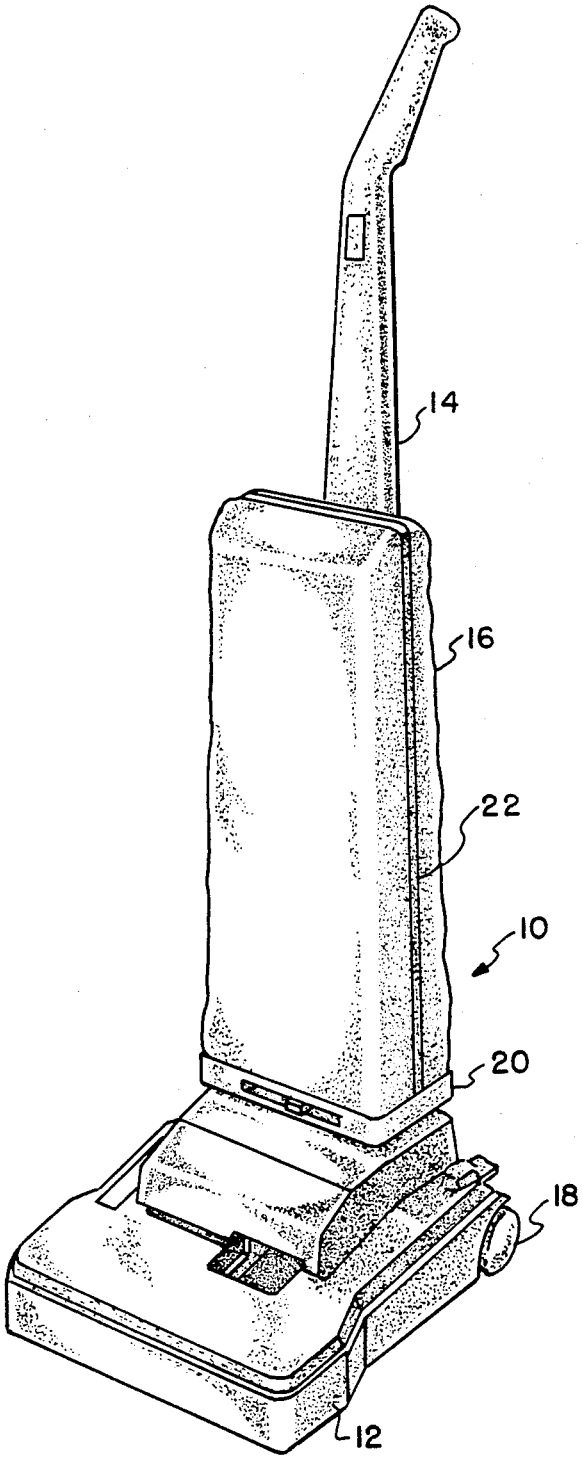
FIG. 1 is a perspective view of a vacuum cleaner incorporating my invention.
Figure 2:
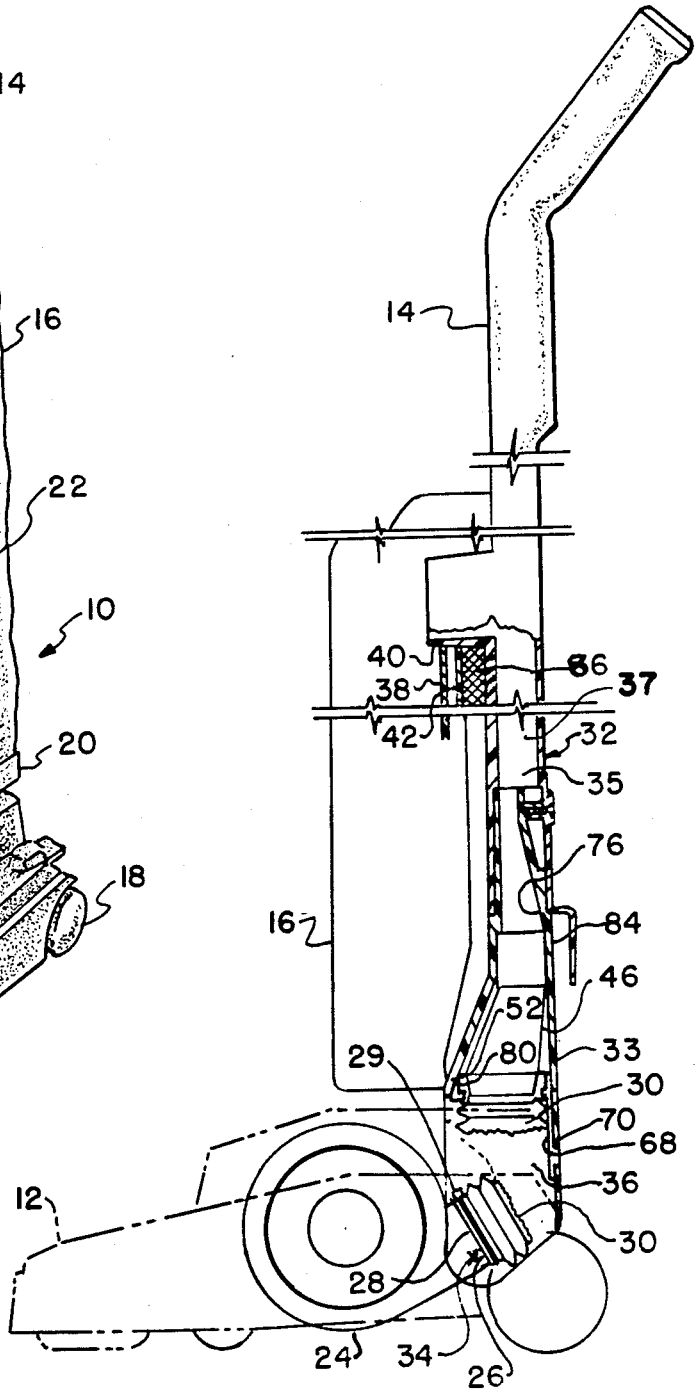
FIG. 2 is a cross sectional elevational view, partly in phantom, of the vacuum cleaner in FIG. 1.
Figure 3:
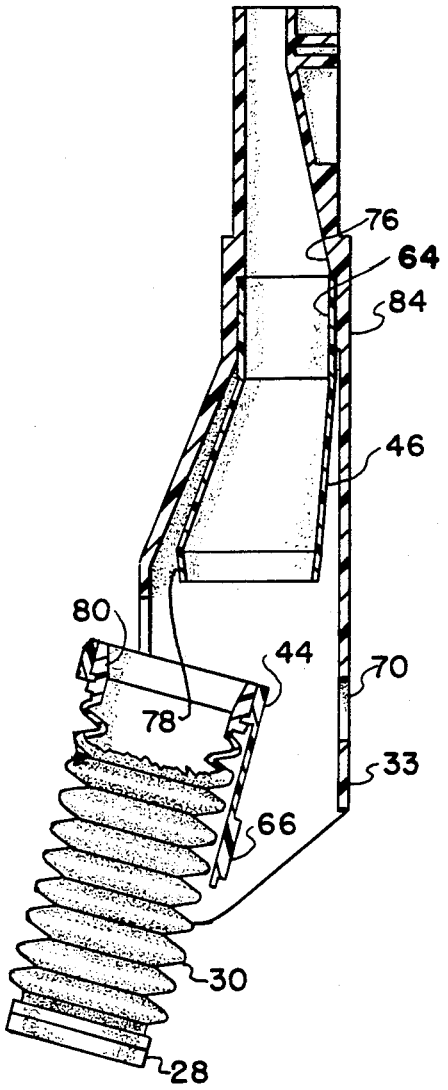
FIG. 3 is a cross sectional elevational view of the bottom portion of FIG. 2 with the bellows and bellows tube adapter partly removed.

There is shown in FIG. 1, a cleaner 10 having a main body or foot 12 and a handle 14 which mounts a soft bag 16. Wheels 18 (only one shown) support the rear of the foot 12. A lower frame 20 fixed to the handle 14, aids in giving a tailored appearance to the bag 16, while a zipper 22 extends around three sides of the bag (only two shown) to provide egress to the interior of the soft bag 16.

Now turning to the remaining Figures of the Drawings, a fan 24 of a motor fan system is disposed in the foot 12 of cleaner 10 to provide for a flow of suction air to the soft bag 16. Fan 24 includes a discharge 26 of tubular configuration, rectangular cross section, over which is telescoped a smooth rectangular end 28 of bellows or bellows tube 30. A clamp 29 holds these two parts together. The bellows 30 is bent upwardly above the end 28 to extend into the handle 14 which also serves as an upper fill tube assembly 32.

The handle 14 is pivoted at pivot 34 by any convenient means, a pair of transversely spaced, ears or lugs 36, 36 extending downwardly from and integral with the handle 14 to form a trunion for this purpose. The bellows 30 extends upwardly between these two lugs. The handle 14 extends above the bellows 30 to mount, as set out above, the bag 16 within which is lodged a paper bag 38 which is in fluid communication with a top fill tube 35 of upper fill tube assembly 32 through a horizontally extending stub tube 40 that communicates with the vertically extending upper fill tube 32. Paper bag 38 includes an apertured face plate 42 which mounts over the stub tube 40.

The inventive aspects of the instant structure will now be detailed. The bellows 30 extends upwardly to be captivated by a bellows tube adapter 44 that is latchingly attached to lower handle duct 33 of upper fill tube 32. A transition or adapter tube 46 is inserted in the upper end of the bellows tube 30 and extends upwardly to conform closely to an air passage 37 formed in top fill tube 35 and lower duct 33 of upper fill tube assembly 32.

More specifically, bellows tube 30 includes, at its upper end, a thickened ovular hollow cylindrical section 48 having an annular groove 50 extending around its outer periphery closely adjacent to the upper end. The section 48 also can be seen to have a draft or outward taper as it extends upwardly. The section 48 fits within a short oval, tapered bore 52 in the bellows tube adapter 44 in a compressing manner to sealingly maintain the bellows tube 30 to the bellows tube adapter 44. The lower portion of tapered bore 52 includes an inset oval rim 56 that provides a flange over which is engaged annular groove 50. This arrangement arrests possible inadvertent axial movement between the two parts and means the bellows tube adapter 44 carries the bellows tube 30.

Figure 4:
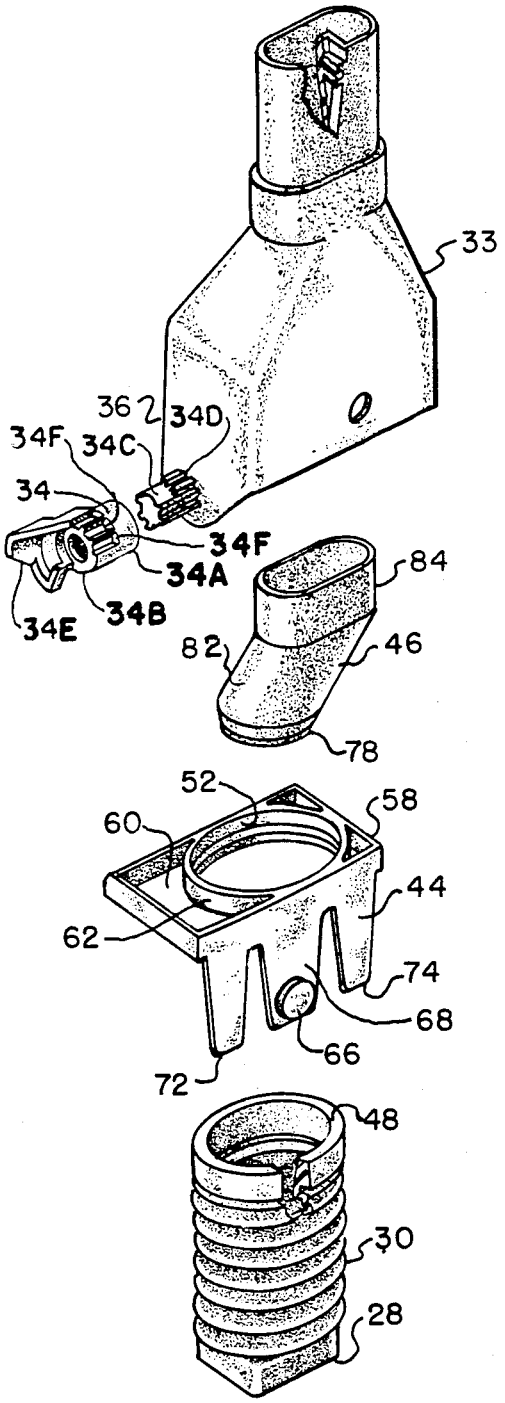
FIG. 4 is an exploded, partial perspective view of the invention.
Figure 5:
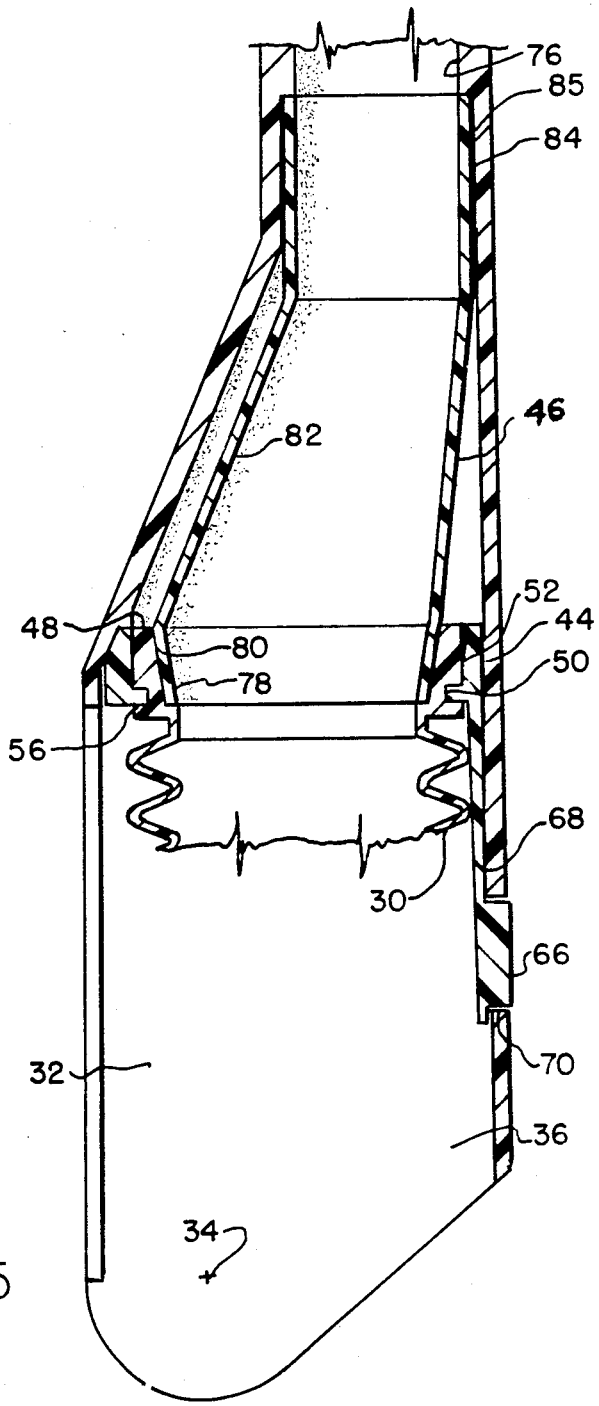
FIG. 5 is an enlarged cross sectional view of lower portions of the upper fill tube configuration.

The configuration of the bellows adapter 44 (FIG. 4) is completed by a reinforcing peripheral short wall 58, rectangular in plan, extending therearound and a floor 60 extending inwardly between this wall and an oval wall 62 forming the oval bore 52. This strengthens the bellows tube adapter 44. It should also be noted the bellows tube adapter, in plan view, conforms in size and shape to lower handle duct 33 of upper fill tube 32 as to slidingly nest therein.

The bellows tube adapter 44 is arrested from vertical or axial movement within upper fill tube 32 by a radially projecting boss 66 integral with and extending from a depending resilient finger 68 of the bellows tube adapter 44. This boss engages in a cross bore 70 in the wall of the lower handle duct 33 of upper fill tube assembly 32 and is maintained therein by the inherent resiliency of finger 68. On opposite sides of this finger are a pair of similar downwardly extending fingers 72, 74 which may be resilient or nonresilient, these fingers tending to make the bellows tube adapter 44 conform to the upper fill tube assembly 32 without canting or tilting.

Above the bellows tube adapter 44 extends the transition tube 46. This tube furnishes a smooth flow transition from that part of the upper fill tube assembly 32 above the bellows adapter 44 to a more medial portion 76, smaller in cross section and offset from lower portion 64, above the bellows adapter 44. Transition tube 46 is downwardly tapered at its lower end 78 to be received within and mate with an aligned internal tapered bore 80 on bellows 30. Above the lower end 78, transition tube 46 includes a necked down portion 82. This necked down portion is also slightly offset to align it properly with the upper fill tube assembly 32 as it extends towards the stub tube 40. Above the necked down portion 82, the transition tube 46 includes a straight section 84 that conforms closely to the upper fill tube assembly 32 in this area to form a lead in for dirty air flowing to the stub tube 40 and thence to the paper bag 38. Glue 85 holds the transition tube 46 to the upper fill tube assembly 32.

The pivot 34, more specifically, is formed on one side by a pivot surface 34A integral with an internally toothed (not shown) external boss 34B that mates over an internal boss 34C having teeth 34D and being integral with one of the ears 36. The external boss 34B advantageously, provides a more wear resistant material than the internal boss 34C for pivoting purposes and may include on the illustrated side, only, a camming arm 34E for actuation of a belt shifting arrangement (not shown) and a pair of slots 34F, 34F which are utilized for handle locking (not shown).

The operation of the invention should now be obvious. In assembly, the transition tube 46 is inserted and glued. The upper end of the bellows 30 is captivatingly mated with the bellows tube adapter 44 by interengagement of the inset rim 56 and peripheral groove 50, and the end of the bellows 30 and attached bellows tube adapter 44 is inserted in the end of the handle 14 (FIG. 4) so that the boss 66 engages in the bore 70. This provides a secure assemblage and an easy and quick assembly. To disassemble the structure, the boss finger 68 is depressed and the bellows 30 and bellows tube adapter 44 are removed as a unit, the transition tube 46 remaining, because of its glued condition, in place in the upper fill tube assembly 32. Thus, clogs in this area may easily be cleared upon quick disassembly of the bellows and bellows tube adapter itself.

The structure also includes a muffler 86, with the same adjacent the upper fill tube assembly 32.

It should be noted that interengagement and captivation of the bellows tube 30 within the bellows tube adapter 44 yields a structure, during assembly or disassembly, where the bellows makes a convenient grasping structure. Thus, the bellows carries the latching means of the adapter to its place of securement.

It should be obvious that the objects of the invention have been complied with by the embodiment described and that all of its objects have been met. Further, many modifications will obviously occur to one skilled in the art which will still fall within the spirit and purview of the description offered.

What is claimed is:

1. An upper fill tube configuration for a vacuum cleaner including;

(a) a flexible bellows for said cleaner extending from a fan of said cleaner, (b) a bellows adapter tube attached to and fluidly communicating with said flexible bellows and being disposed thereabove, (c) a duct disposed at least partially above said tube, (d) said flexible bellows and adapter tube being inserted into said duct and said adapter tube being attached thereto for assembly, (e) a second tube disposed above said adapter tube and (f) said second tube being tapered at its lower end on its outer surface to provide inserted sealing with an internal tapered portion on said flexible bellows.

2. The upper fill tube configuration of claim 1 wherein;

(a) said second tube, at its upper end, closely conforms to said duct to provide a lead in for the flow of air into said duct.

3. An upper fill tube configuration for a vacuum cleaner including;

(a) a flexible bellows tube extending from a fan for said vacuum cleaner, (b) a bellows tube adapter captively and fluidly connected to said bellows tube, (c) a duct disposed at least partly above said bellows tube adapter and said flexible bellows, (d) said bellows tube adapter, along with said flexible bellows tube, attached to said duct, (e) a second tube disposed generally above said bellows tube adapter in said duct and confluently sealing with said flexible bellows tube.

4. The upper fill tube configuration for a vacuum cleaner as set out in claim 3 wherein;

(a) said second tube is tapered at its lower end to aid in sealing insertion with said flexible bellows tube.

* * * * *